US006889973B2

(12) United States Patent
Gämmerler et al.

(10) Patent No.: US 6,889,973 B2
(45) Date of Patent: May 10, 2005

(54) VERTICAL LOG STACKER

(75) Inventors: Gunter Gämmerler, Gelting (DE); Ralf Peter Schubart, Kochel am See (DE)

(73) Assignee: Gammerler AG, Geretsried-Gelting ( * ) Notice: Subject to any disclaimer, the term of this patent is extended or adjusted under 35 U.S.C. 154(b) by 52 days.

(21) Appl. No.: 10/107,033

(22) Filed: Mar. 27, 2002

(65) Prior Publication Data

US 2002/0140160 A1 Oct. 3, 2002

(30) Foreign Application Priority Data

Mar. 28, 2001 (DE) ..... 101 15 251

(51) Int. Cl.[7] ..... B65H 31/12

(52) U.S. Cl. ..... 271/198; 271/207; 271/214; 271/181

(58) Field of Search ..... 271/207, 214, 271/131, 198

(56) References Cited

U.S. PATENT DOCUMENTS

| | | | | |
|---|---|---|---|---|
| 3,180,638 A | | 4/1965 | Meylan | |
| 3,822,793 A | | 7/1974 | Stobb | |
| 4,541,763 A | | 9/1985 | Chandhoke et al. | |
| 4,772,003 A | | 9/1988 | Nobuta et al. | |
| 4,897,017 A | | 1/1990 | Castiglioni | |
| 5,054,763 A | * | 10/1991 | Achelpohl et al. | 271/182 |
| 5,190,281 A | * | 3/1993 | Cardenas | 271/198 |
| 5,215,428 A | | 6/1993 | Masini | |
| 5,346,206 A | * | 9/1994 | Steinhart | 271/305 |
| 5,460,479 A | * | 10/1995 | Neumann et al. | 414/789.5 |

FOREIGN PATENT DOCUMENTS

| | | |
|---|---|---|
| DE | 19 39 232 A | 2/1971 |
| DE | 22 31 743 C3 | 4/1973 |
| DE | 26 28 452 A1 | 1/1977 |
| DE | 35 07 009 A1 | 3/1984 |
| DE | 35 07 009 A1 | 9/1985 |
| DE | 36 01 295 A1 | 7/1987 |
| DE | 36 23 077 A1 | 2/1988 |
| EP | 0 243 769 A2 | 4/1987 |
| GB | 14 72 248 A | 5/1977 |

OTHER PUBLICATIONS

European Search Report for Application No. 02006837.5 dated Nov. 6, 2003.

Translation of European Search Report for Application No. 02006837.5 dated Nov. 6, 2003.

* cited by examiner

*Primary Examiner*—Donald P. Walsh
*Assistant Examiner*—Kaitlin Joerger
(74) *Attorney, Agent, or Firm*—Fitch, Even, Tabin & Flannery

(57) ABSTRACT

A vertical log stacker has a product feeder and a stacking section adjacent to this, wherein a plurality of handling elements are provided in the region of the stacking section with which a continuous forming of logs is made possible.

12 Claims, 2 Drawing Sheets

VERTICAL LOG STACKER

FIELD OF THE INVENTION

The present invention relates to a vertical log stacker for forming vertical stacks, so-called logs, from printed products which are delivered in an overlapping stream.

BACKGROUND OF THE INVENTION

Such known log stackers have a product feeder to feed the overlapping stream in a transport direction and a stacking section. The stacking section is adjacent to the product feeder and has an upper start and a lower end. Furthermore, a plurality of handling elements are provided in the region of the stacking section for the continuous forming of logs.

BRIEF SUMMARY OF THE INVENTION

It is the object of the present invention to improve a log stacker such that the printed products stacked to form a log suffer less damage at high performance.

This object is satisfied by the features in particular in that the upper start of the stacking section is inclined in the transport direction relative to the vertical.

In accordance with the invention, the upper start of the stacking section is inclined relative to the lower start, and indeed in the transport direction, such that the leading edges (fold) of the printed products put down in the region of the stacking section slip toward a stop provided in the region of the stacking section on their own due to gravity. In this manner, lower forces can be applied in the guiding through of the printed products by the product feeder and in the holding down of the backs of the products, whereby a marking of the printed products by holding down elements or pressing bands is avoided. At the same time, an improved log stacker results overall since the products align themselves.

Advantageous embodiments of the invention are described in the description, the claims and the drawings.

In accordance with a first advantageous embodiment, the handling elements can have at least one rake which can be displaced along the stacking section, which can be moved into the stacking section and whose upper end position is arranged above the overlapping stream fed by the product guide. The upper end position, i.e. the waiting position of the rake, thus lies above the fed overlapping stream such that the rake contacts the log from above. In this manner, the log end is held securely so that it cannot slip.

In accordance with a further advantageous embodiment, the handling elements have at least one lowering fork which can be displaced along the stacking section and in whose displacement path a first feeder for end plates is arranged. The lowering fork serves in a known manner to lower the log during the log forming process. In accordance with the invention, the possibility exists, when the lowering fork is moved back, to take over an end plate for the next log to be formed, since an end plate feeder is provided in the displacement path of the lowering fork. This first feeder for end plates is thus arranged in a region which is uncritical both spatially and also seen from the time sequence.

In accordance with a further advantageous embodiment, the handling elements have a holding rake which can be displaced along the stacking section, which can be moved into the stacking section and in whose displacement path a second feeder for end plates is arranged. In accordance with the invention, the possibility also exists here of a second end plate, for example an upper end plate, being placed onto the holding rake from above after this has been moved along the stacking section.

In accordance with a further embodiment of the invention, the handling elements can have a separating rake which can be displaced along the stacking section, which can be moved into the stacking section and whose prongs are provided with a contact band which can be rolled off over a roll provided at the tip of the prong when the rake is retracted from the stacking section. It can be prevented by such a separating rake with a roll-off contact band or withdrawal band that a relative movement takes place between the rake and the product stack located above it in that the contact band is rolled off over the roll during the retraction of the rake. It is hereby prevented that the printed products to be transferred over are damaged or marked.

In accordance with a further embodiment of the invention, the product feeder has at least three pressing belts which extend in the transport direction and are spaced transversely to the transport direction. Due to such pressing belts, the fed-in overlapping stream of printed products can be accelerated and introduced into the stacking section in a pre-pressed manner, with a proper orientation of every single printed product being ensured at the same time.

In accordance with a further embodiment of the invention, the product feeder can be designed such that the position of the two outer pressing belts can be adjusted transversely to the transport direction. In this manner, a simple adjustability is ensured, since the center pressing belt can maintain its position even with different formats, whereas only the two outer pressing belts have to be adjusted. An adjustability of the respective outermost pressing belts additionally has the advantage that each printed product of the fed-in overlapping stream is always held and pressed at head and foot when this is introduced into the stacking section.

A total of six pressing belts are preferably provided in the product feeder, with the two innermost pressing belts not being adjustable transversely to the transport direction, and with the relative position of the two outermost pressing belts and the relative position of the pressing belt adjacent thereto in each case being adjustable transversely to the transport direction. Such a product feeder can also be used with multi-prong rakes for different format sizes since an adjustment to different formats is possible in a simple manner by the adjustability of the pressing belts. It is again ensured at the same time that the products are always securely pressed and held at their two most extreme opposite edges, i.e. at head and foot. At the same time, a particularly simple adjustment of the pressing belts results.

In accordance with a further advantageous embodiment of the invention, the product feeder and the handling elements are secured to a common base, with the spacing between the base and the stacking section being adjustable in the transport direction. In this way, the format can also be adapted in the transport direction, i.e. in the broad orientation of the printed products, with a particularly simple adjustability again being ensured since only the base has to be adjusted to the product width in the transport direction.

In accordance with a further advantageous embodiment, a unit is provided for the introduction of a gap into the overlapping stream which is arranged at such a height above the floor that it can easily be reached by an operator standing on the floor, with a transport device being provided for the further transport of the product stream to the product feeder provided at the upper end of the stacking section. Such an embodiment provides a substantial operating advantage since the adjustment of the unit for the introduction of a gap into the overlapping stream can be easily made by the operator without his having to stand on a ladder, a platform or the like.

In accordance with a further advantageous embodiment, a displacement unit can be provided which transfers a completely formed log guided at all sides from the region of the stacking section to a pressing and banding unit. In this manner, a fully automatic operation of the machine results, with it nevertheless being ensured that the completely formed log is also guided at all sides on the transfer to the pressing and banding unit.

BRIEF DESCRIPTION OF THE DRAWINGS

The present invention will be described in the following purely by way of example with reference to advantageous embodiments and to the enclosed drawings. There are shown FIG. 1 a greatly simplified schematic side view of a vertical log stacker.

DETAILED DESCRIPTION OF THE PREFERRED EMBODIMENTS

Figure 1:
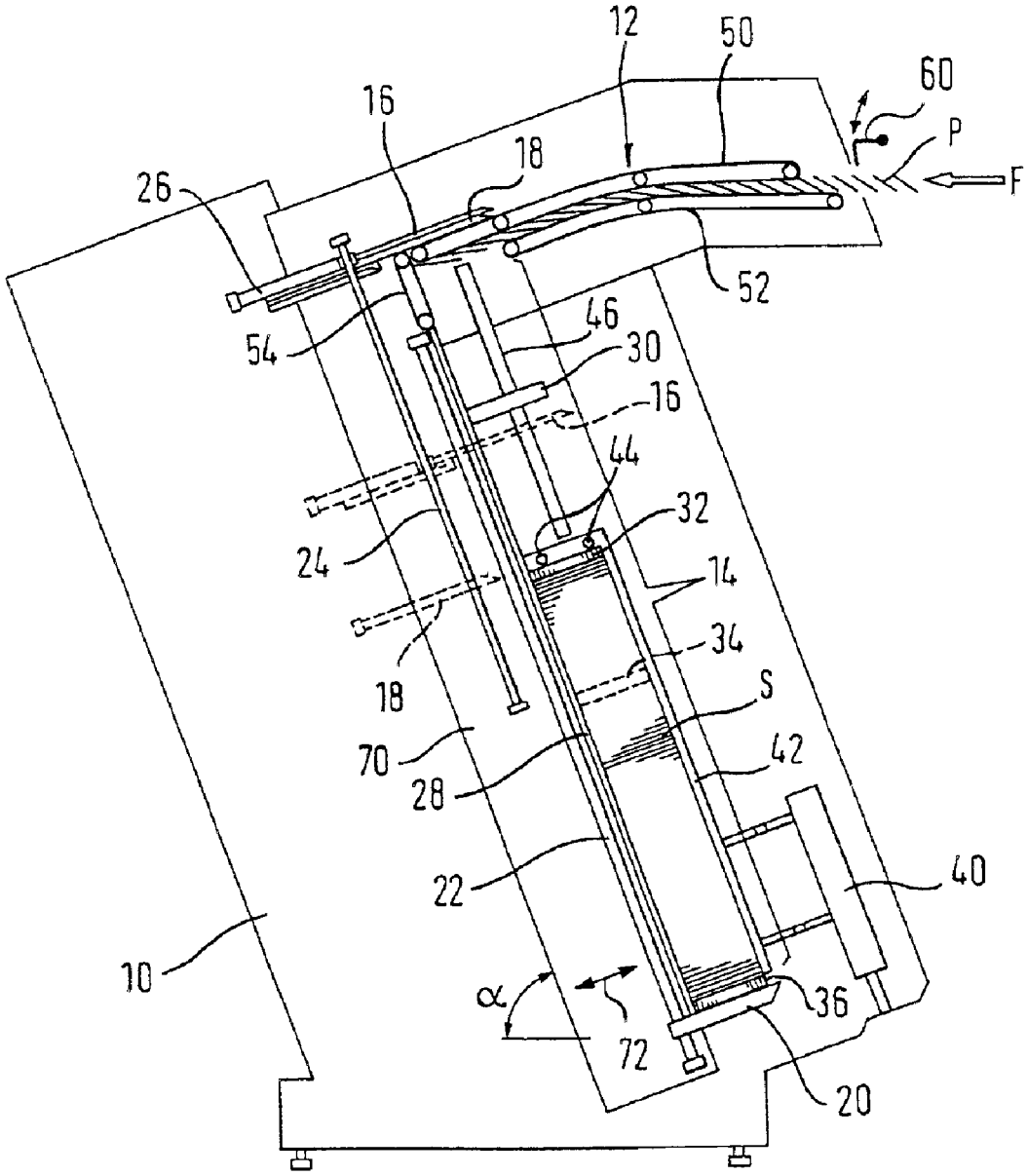

FIG. 1 shows a side view of a vertical log stacker for the forming of logs S from printed products delivered in an overlapping stream P. The log stacker has a product feeder 12 on a base frame 10 for feeding the overlapping stream P in a transport direction F, with a stacking section 14 in a straight line adjoining the product feeder 12 with an upper start in the region of the product feeder P and with a lower end. A plurality of handling elements are provided in the region of the stacking section 14 to form individual logs S continuously from the delivered overlapping stream P. Individually these are a separating rake 16, a holding rake 18 and a lowering fork 20, which are each displaceably secured at the base frame 10 along the stacking section 14. In this connection, the lowering fork 20 can be displaced along a guide 22, whereas the separating rake 16 and the holding rake 18 are displaceable along a guide 24. Both guides overlap one another along the stacking section 14.

Both the separating rake 16 and the holding rake 18 can be moved into the stacking section 14 (cf. representation in FIG. 1) and can be moved backward out of the region of the stacking section 14 with the aid of setting cylinders 26.

As FIG. 1 shows, the stacking section 14 is inclined, and indeed such that the upper start of the stacking section 14 is inclined relative to the vertical in the transport direction F (and not counter to the transport direction). In this way, a stop 28 provided at the rear of the transport section 14 includes an acute angle $\alpha$ with the horizontal which amounts, for example, to 70° and which opens in the transport direction.

Approximately in the center third of the stacking section 14, a first feeder 34 for end plates 36 is provided parallel to the rakes 16, 18. A second feeder 30 for end plates 32 is provided in the upper third of the stacking section at a right angle to the stop 28 and parallel to the first feeder 34. A stacking plate 32 or 36 respectively can be introduced into the stacking section 14 through the feeders 30 and 34, with the lowering fork 20 taking over an end plate 36 from the feeder 34 and the holding rake 18 taking over an end plate 32 from the guide 30, which will be explained in more detail in the following.

As FIG. 1 further shows, a displacement device 40 is arranged in the lower region of the stacking section 14. The completely formed log S can be transferred to a pressing and banding unit (not shown) from the region of the stacking section 14 with this displacement device. For this purpose, the log S is displaced in a direction perpendicular to the plane of the drawing. The log is subsequently pressed and banded.

To achieve a guide of the log S at all sides during the transfer, the displacement device 40 has a plurality of pivotal holding brackets 42 which are provided with spigots 44 which press onto the upper side of the upper end plate 32 when the holding brackets 42 are flipped closed. A side guide 46 for the log S can be provided above the holding brackets 42.

The product feeder 12 has a plurality of upper and lower pressing belts 50, 52 which guide the delivered overlapping stream P of printed products between them and thereby press. The upper pressing belts 50 are longer than the lower pressing belts 52 and the front end of the upper pressing belts 50, 52 extends into the upper end of the stacking section 14. In this region, a plurality of withdrawal bands 54 are provided at the side of the stop 28 parallel to and substantially coincident with this, with whose aid the product back (fold) of the printed products transported into the stacking section 14 is pulled downwardly.

Figure 2:
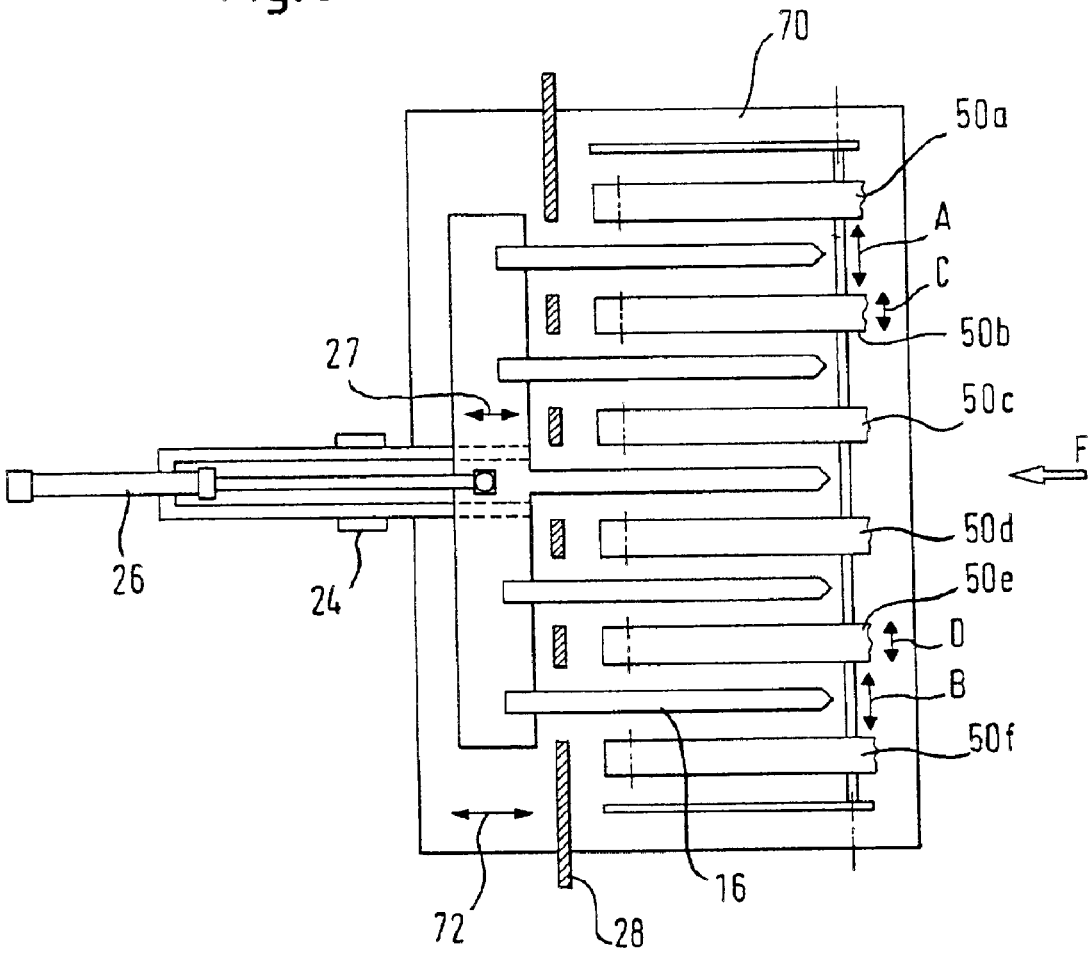
FIG. 2 a greatly simplified plan view of the product feeder with inserted rake.

As FIG. 1 illustrates, the upper end position of the separating rake 16 and of the holding rake 18 lies above the overlapping stream P fed through the product guide 12 when its products enter into the stacking section 14. This means that the rakes 16, 18 dip through the overlapping stream in a lowering movement. Since the upper pressing belts 50 of the product feeder 12 are guided into the region of the stacking section (cf. FIG. 1), the rakes 16, 18 must mesh with the upper pressing belt 50. FIG. 2 shows a plan view of this arrangement in detail.

In FIG. 2, a plan view of the separating rake 16 is shown which meshes with the pressing belts 50*a*–50*f* of the product feeder 12. At the same time, it can be recognized that the prongs of the separating rake 16 are guided through slots provided in the stop 28 and that the separating rake 16 can be moved in the direction of the double arrow 27 into and out of the stacking section 14 with the aid of the setting cylinder 26. The separating rake 16 has five prongs in the embodiment shown, with one prong each coming to rest between two adjacent pressing belts 50*a*, 50*b*, 50*c*, 50*d* and 50*e*, 50*f*. When the separating rake 16 is lowered along the guide 24, the prongs of the rake 16 mesh with the pressing belts of the product feeder 12 so that the rake 16 can pass through the product feeder 12.

The separating rake 18 is formed in the same way as the separating rake 16 and is lowered together with the separating rake 16 from the position shown in FIG. 1, with both rakes being located directly on top of one another at the start of the lowering movement.

The function of the above-described log stacker will be described in the following:

FIG. 1 shows an operation position which does not occur per se in normal operation. In normal operation, in contrast, when the lowering fork 20 is fully lowered, the separating rake 16 is located approximately in the position shown by broken lines, whereas the holding rake 18 is located approximately in the upper end region of the completely formed log S. In the representation of FIG. 1, the holding rake 18 has already been pulled out of the stacking section 14 and the holding brackets 42 have been flipped open so that the log S is held by the spigots 44. After the log S has been removed from the region of the stacking section 14 by the displacement device 40, the lowering fork 20 is moved along the guide 22 up to the continuously lowering separating rake 16. In this connection, the lowering fork 20 takes up a lower end plate 36 on passing through the feeder 34. After the lowering fork 20 has been guided to the lower side of the separating fork 16, it is pulled out of the stacking section 14 with the aid of the setting cylinder 26 so that the part stack (not shown) of printed products, which is located at the separating rake 16, is transferred to the lowering fork 20, i.e. the stack is placed on the end plate 36 which is located on the lowering fork 20. The lowering fork 20 is subsequently continuously further lowered, whereby the part stack located on the lowering fork 20 is constantly enlarged. At the same time, the two pulled out rakes 16 and 18 are moved at high speed into their upper end position (waiting position) which is represented by solid lines in FIG. 1. In this upper end position, both rakes lie directly on top of one another so that these can be moved together into the upper end region of the stacking section 14 when the log located on the lowering fork 20 has reached the desired height.

The separating rake 16 and the holding rake 18 shoot into the stacking section 14 together after a separating apparatus 60 has produced a certain gap in the overlapping stream and after this gap has extended into the region of the stacking section 14. Subsequently, these are simultaneously lowered so that they mesh with the pressing belts 50*a*–50*f* of the product feeder 12. The holding rake 18 is subsequently moved downwardly at the same speed as the lowering fork 20 so that the completely formed log is clamped between the lowering fork 20 and the holding rake 18. The separating rake 16 is lowered at the usual log forming speed so that a new part stack is formed on this.

When the completely formed log S is lowered, an upper end plate 32 is transferred via the feeder 30 to the upper side of the holding rake after this has passed through the feeder 30. The log S is subsequently lowered into the bottommost position shown in FIG. 1 and the holding brackets 42 are closed so that the holding rake 18 can be pulled out. The cycle subsequently starts afresh.

Printed products with different formats can also be stacked with the above-described log stacker without complicated adaptations being required for this. For this purpose, the log stacker has a format adjustment facility which acts in the transport direction F and a format adjustment facility which acts transversely to the transport direction F of the delivered products P.

As FIG. 2 illustrates, the product feeder in the embodiment shown has six upper pressing belts 50*a*–50*f* which are secured to a base 70. All pressing belts extend in parallel and each accept a prong of the rakes 16 and 18 between them. As indicated in FIG. 2 by double arrows, the two respective outermost pressing belts 50*a* and 50*f* can be adjusted relatively to the product transport direction F (arrows A, B), with additionally a relative adjustment being possible between the respective two outermost pressing belts 50*a* and 50*b* and 50*e* and 50*f* respectively (arrows, C, D). It is ensured in this way that each product is held in each case by pressing belts (pressing belts 50*a* and 50 at its two outermost edges lying transverse to the transport direction and that the other pressing belts are distributed evenly over the surface of the product.

A different product width can be achieved by an adjustment of the base 70 along the double arrow 72. Since the guide 24 of the rake 16, 18 and also the guide 22 of the lowering fork 20 are connected to the base 70, an adaptation to all required settings is effected solely by adjusting the base 70 along the double arrow 72.

Figure 3:
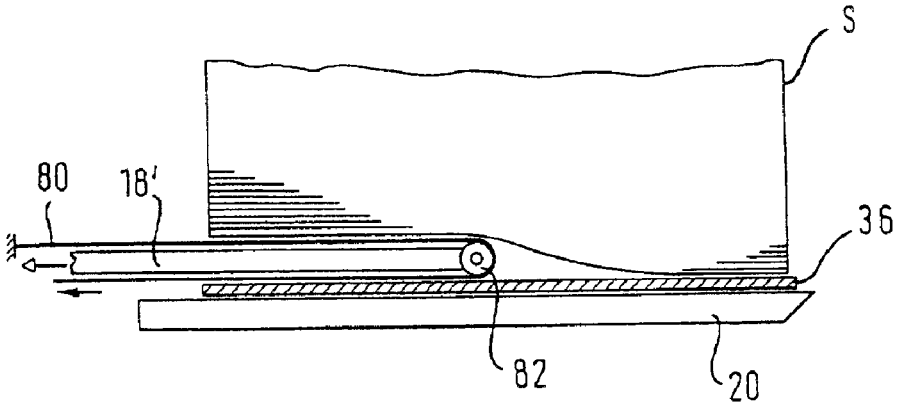
FIG. 3 a simplified side view of a rake provided with a contact band on the transfer of a product stack.

FIG. 3 shows an alternative embodiment of a holding fork 18' on the transfer of a formed part stack S to the lowering fork 20 or to the end plate 36 located on this. In this alternative embodiment, a deflection roll 82 is provided at the ends of each prong of the separating fork 18', with a contact band 80 being guided around each deflection roll 82. When the rake 18' is retracted, the upper run of the contact band 80 is fixedly held at the left hand end (in FIG. 3) so that when the rake 18' is pulled out simultaneously with the lower run of the contact band 80, this can roll off around the deflection roll 82. In this way, the part stack S located on the contact band 80 is rolled off without a relative movement taking place between the rake 18' and the part stack S. In this way, an extremely gentle transfer of the formed part stacks can take place.

In accordance with a further embodiment (not shown), the separation device 60 for the introduction of a gap into the overlapping stream is provided at such a height above the floor that it can be easily reached by an operator standing on the floor. In this connection, a transport device is provided for the further transport of the product stream to the product fed 12 provided at the upper end of the stacking section 14. In this embodiment, an adjustment of the separating device 60 can take place comfortably, simply and reliably by an operator without aids such as ladders, stools or the like being necessary.

What is claimed is:

1. A log stacker for forming logs from printed products delivered in an overlapping stream, comprising a product feeder for feeding the overlapping stream in a transport direction, a stacking section in a straight line adjoining the product feeder and with an upper start and a lower end, and a plurality of handling elements in the region of the stacking section for a continuous forming of stacks, wherein the handling elements comprise one lowering fork and two rakes, wherein said rakes are displaceable along the stacking section and are adapted to be moved together into the stacking section, and wherein an upper end waiting position of both rakes is arranged above the overlapping stream fed by the product feeder.

2. A log stacker in accordance with claim 1, wherein the lowering fork is displaceable along the stacking section and wherein in a displacement path of the lowering fork a feeder for end plates is arranged.

3. A log stacker in accordance with claim 1, wherein the handling elements comprise a holding rake which is displaceable along the stacking section, which can be moved into the stacking section and in whose displacement path a feeder for end plates is arranged.

4. A log stacker for forming logs from printed products delivered in an overlapping stream, comprising a product feeder for feeding the overlapping stream in a transport direction, a stacking section in a straight line adjoining the product feeder and with an upper start and a lower end, and a plurality of handling elements in the region of the stacking section for a continuous forming of stacks, wherein the handling elements comprise one lowering fork and two rakes, wherein said rakes are displaceable along the stacking section and can be moved into the stacking section, and wherein a first feeder for end plates is provided for placing an end plate onto the lowering fork and a second feeder for end plates is provided for placing an end plate onto one of said rakes.

5. A log stacker for forming logs from printed products delivered in an overlapping stream, comprising a product feeder for feeding the overlapping stream in a transport direction, a stacking section in a straight line adjoining the product feeder and with an upper start and a lower end, and a plurality of handling elements in the region of the stacking section for a continuous forming of stacks, and wherein the handling elements comprise a separating rake which is displaceable along the stacking section, which can be moved into the stacking section and whose prongs are provided with a contact band which can be rolled off over a roll provided at the tip of the prong on the retraction of the rake.

6. A log stacker for forming logs from printed products delivered in an overlapping stream, comprising a product feeder for feeding the overlapping stream in a transport direction, a stacking section in a straight line adjoining the product feeder and with an upper start and a lower end, and a plurality of handling elements in the region of the stacking section for a continuous forming of stacks, wherein the product feeder comprises at least three pressing belts extending in a transport direction and spaced transversely to the transport direction, with the relative position at least of two outer pressing belts being adjustable transversely to the transport direction.

7. A log stacker in accordance with claim 6, characterized in that a total of six pressing belts are provided, with two innermost pressing belts not being adjustable transversely to the transport direction and with the relative position of the two outermost pressing belts and the relative position of the pressing belt adjacent thereto in each case being adjustable transversely to the transport direction.

8. A log stacker for forming logs from printed products delivered in an overlapping stream, comprising a product feeder for feeding the overlapping stream in a transport direction, a stacking section in a straight line adjoining the product feeder and with an upper start and a lower end, and a plurality of handling elements in the region of the stacking section for a continuous forming of stacks, wherein the handling elements comprise one lowering fork and two rakes, wherein said rakes are displaceable along the stacking section and can be moved into the stacking section, and wherein the product feeder and the handling elements are secured on a common base, with the relative position between the base and the stacking section being adjustable in the transport direction.

9. A log stacker in accordance with claim 1, wherein a unit is provided for introducing a gap into the overlapping stream which is arranged at such a height above the floor that it can easily be reached by an operator standing on the floor; and in that a transport device is provided for the further transport of the product stream to the product feeder provided at the upper end of the stacking section.

10. A log stacker in accordance with claim 4, wherein a unit is provided for introducing a gap into the overlapping stream which is arranged at such a height above the floor that it can easily be reached by an operator standing on the floor; and in that a transport device is provided for the further transport of the product stream to the product feeder provided at the upper end of the stacking section.

11. A log stacker in accordance with claim 5, wherein a unit is provided for introducing a gap into the overlapping stream which is arranged at such a height above the floor that it can easily be reached by an operator standing on the floor; and in that a transport device is provided for the further transport of the product stream to the product feeder provided at the upper end of the stacking section.

12. A log stacker in accordance with claim 6, wherein a unit is provided for introducing a gap into the overlapping stream which is arranged at such a height above the floor that it can easily be reached by an operator standing on the floor; and in that a transport device is provided for the further transport of the product stream to the product feeder provided at the upper end of the stacking section.

* * * * *